US007462790B2

(12) United States Patent
Miki

(10) Patent No.: US 7,462,790 B2
(45) Date of Patent: Dec. 9, 2008

(54) CUSHIONING MEANS HOLDING MEMBER, AND SLIDE SWITCH INCLUDING THE SAME

(75) Inventor: Toru Miki, Tokyo (JP)

(73) Assignee: Miyama Electric Co., Ltd., Tokyo (JP)

( * ) Notice: Subject to any disclaimer, the term of this patent is extended or adjusted under 35 U.S.C. 154(b) by 360 days.

(21) Appl. No.: 10/586,151

(22) PCT Filed: Jan. 15, 2004

(86) PCT No.: PCT/JP2004/000231

§ 371 (c)(1),
(2), (4) Date: Jul. 14, 2006

(87) PCT Pub. No.: WO2005/069325

PCT Pub. Date: Jul. 28, 2005

(65) Prior Publication Data

US 2008/0237022 A1 Oct. 2, 2008

(51) Int. Cl.
*H01H 15/10* (2006.01)

(52) U.S. Cl. ..... 200/16 R; 200/547

(58) Field of Classification Search ..... 200/16 R–16 D, 200/547–551

See application file for complete search history.

(56) References Cited

U.S. PATENT DOCUMENTS

| | | | | |
|---|---|---|---|---|
| 3,209,088 | A * | 9/1965 | Wanlass et al. | 200/16 C |
| 3,614,346 | A * | 10/1971 | Gudaitis et al. | 200/16 D |
| 3,833,784 | A * | 9/1974 | Bobel et al. | 200/43.17 |
| 5,959,309 | A * | 9/1999 | Tsui et al. | 257/48 |
| 6,621,018 | B1 * | 9/2003 | Chen | 200/16 C |
| 6,841,744 | B1 * | 1/2005 | Kodo et al. | 200/16 C |

* cited by examiner

*Primary Examiner*—Michael A Friedhofer
(74) *Attorney, Agent, or Firm*—Sughrue Mion, PLLC

(57) ABSTRACT

A slide switch includes a slider, a case into which the slider is inserted, performing switching by a sliding operation of the slider, cushioning (an upper part, a left part, and a right part) provided at contacting places in the side of the slider where the slider and the case come into contact by the sliding operation of the slider for relieving the contact, and a cushioning holding member for integrally supporting the cushioning, wherein the case has case inner faces on which the slider slides, and which face each other along a horizontal direction, one of the inner faces of the case has a positioning part for positioning the slider at three positions, and the other of the inner faces of the case has a positioning part for positioning the slider at two positions. The cushioning can reduce generation of vibration noise of the slide switch due to vibration of a vehicle under running and operation noise due to a switching operation to improve an operation feeling of the vehicle.

7 Claims, 8 Drawing Sheets

CUSHIONING MEANS HOLDING MEMBER, AND SLIDE SWITCH INCLUDING THE SAME

TECHNICAL FIELD

The present invention relates to a cushioning means holding member and a slide switch including the same, and particularly to a cushioning means holding member including a slider which slides within the slide switch by a lever, and a case into which the slider is inserted for performing switching by a sliding operation of the slider and a slide switch including the same.

BACKGROUND ART

Conventionally, a slide switch is disclosed which relieves, by a cushioning function of a leaf spring mounted on a case or a slider, contact occurring when a slider sliding within the slide switch and the case housing the slider come into contact with each other in order to reduce operation noise generated by a switch operation of the slide switch (see, for example, Japanese laid-open patent application publication No. 2002-42608). Whenever the lever of the slide switch is moved in a horizontal direction, the slider slides, so that terminals of the slide switch turn on and off to provide switching of the slide switch. In this event, a leaf spring having an elastic characteristic is mounted as a cushion member on a portion where the slider sliding by the operation of the lever comes in contact with the case to reduce generation of the operation noise due to the switch operation.

The slider is a sliding part capable of the switch operation and also referred to as movable member.

FIG. 8 is a configuration drawing showing an outline of a conventional slide switch to illustrate a three-position type one capable of three-position switching. As shown in FIG. 8, the slide switch 120 comprises a lever 122 functioning as a handle in the switching operation, a slider 124 in which the lever is fitted, a case 110 having a space enabling the slider 124 to slide, and a substrate 130 on which the slider 124 is mounted. On a lower face of the substrate 130 are provided terminals 130*a*, 130*b*, and 130*c*. When the slider 124 slides by the operation to the lever, the slide switch 120 turns on and off with the terminals 130*a*, 130*b*, and 130*c*. As described above, the slide switch is configured as the three-position type one, and a slide switch of two-position type and the like are configured individually.

The case 110 is formed by a process of folding a frame 111 so as to cover a periphery of the slider 124. When the lever 122 of the slide switch 120 is moved in a horizontal direction, the terminals 130*a*, 130*b*, and 130*c* are electrically turned on and off to provide switching of the slide switch 120. Further, a leaf spring 121 having an elastic characteristic is mounted as the cushion member at a place where the slider 124 sliding by the operation of the lever 122 comes into contact with the case 110. The operation of the lever 122 slides the slider 124. When the slider 124 and the case 110 come into contact, the leaf spring 121 cushions the contact by its cushioning function. This can reduce generation of the operation noise due to the switch operation.

However, such the slide switch 120 has a clearance between the slider 124 and the case 110 in an up-down direction. Accordingly, this clearance allows the slider 124 to vibrate in the up-down direction. Thus, the slide switch generates vibration noise due to vibration of a vehicle under traveling. This vibration noise is dissonant for a driver, resulting in a bad operation feeling.

Further, the leaf spring 121, which is the cushion member, is a different member, so that another work of mounting it on the case 110 is required.

Accordingly, a slide switch according to the present invention is developed to solve such the problem and has a problem of reducing the generation of the vibration noise of the slid switch due to the vibration of the vehicle under traveling and the operation noise due to the switching operation.

DISCLOSURE OF THE INVENTION

A cushioning means holding member according to the present invention recited in claim 1 is: provided in a slide switch including a slider and a case into which the slider is inserted to provide switching by a sliding operation of the slider; provided at a contacting place on the side of the slider where the slider comes in contact with the case by a sliding operation of the slider for relieving the contact; and characterized in that the cushioning means holding member integrally includes cushioning means for cushioning in at least one of a horizontal direction in which the slider is slide and a vertical direction in which upward-downward movement of the slider is limited.

According to the invention recited in claim 1, because the cushioning means integrated with the cushioning means holding member is fixed to the slider, it is possible to reduce generation of vibration noise of the slide switch due to vibration of a vehicle under traveling and generation of operation noise due to a switching operation to improve an operation feeling of the vehicle. Further, the slider includes the cushioning means holding member, so that man-hour of an assembling process can be reduced.

The cushioning means holding member recited in claim 2 is, in the invention recited in claim 1, characterized in that the cushioning means is provided at the contacting place on the side of the slider and is a leaf spring protruding in a shape of a mark of "<" in a horizontal direction.

According to the invention recited in claim 2, the cushioning means is the leaf spring, protruding in the shape of the mark of "<", so that it can be easily shaped from a spring member of a plate.

The cushioning means holding member recited in claim 3 is, in the invention recited in claim 1, characterized in that the cushioning means is provided at the contacting place on the side of the slider and is a leaf spring curved in a semicircle in the vertical direction.

According to the invention recited in claim 3, the cushioning means provided using a leaf spring curved in a semicircle in the vertical direction.

The cushioning means holding member recited in claim 4 is, in the invention recited in claim 1, characterized in that the cushioning means is a springy member, formed of a material having an elasticity.

According to the invention recited in claim 4, the cushioning means is a springy member, formed of a material having an elasticity, so that the cushioning means can be easily formed integrally with the cushioning means holding member.

A slide switch recited in claim 5 is, in the invention recited in any one of claims 1 to 4, characterized in that the cushioning means holding member is provided.

According to the invention recited in claim 5, because the slider can perform cushioning in the horizontal direction in which the slider is slidably operated and in the vertical direction in which the upward-downward movement of the slider is limited, the vibration noise of the slide switch due to the vibration of the vehicle under traveling and the operation noise due to the switching operation can be reduced with an improved operation feeling. Further, the slider includes a cushioning means holding member, so that man-hour for an assembling process can be reduced.

The slide switch recited in claim 6 is, in the invention recited in claim 5, is characterized in that the case has case inner faces in which the slider slides, the case inner faces face with each other along the horizontal direction, one of the case inner faces has a positioning part for positioning the slider at three positions, and the other of the case inner faces has a positioning part for positioning the slider at two positions.

According to the invention recited in claim 6, the case has the positioning part for switching the slide switch between the three positions and the two positions on the case inner faces in a front-rear direction, so that one case can be commonly used. This can save a metal mold for shaping the case.

The slide switch recited in claim 7 is, in the invention recited in claim 5, is characterized in that the slider includes a protruding part protruding from a lower face of a slider body, and the protruding part is pressed by an elastic member to support the slider on a substrate so as to make the slider slidable.

According to the invention recited in claim 7, because the slider has a protruding part protruding from the lower face of the slider body and the protruding part is supported by the elastic member such as a coil spring, the upward-downward movement of the slider can be cushioned. This can reduce the generation of the vibration noise of the slide switch due to the vibration of the vehicle under traveling and the operation noise due to the switching operation with the improved operation feeling of the vehicle.

BEST MODE FOR CARRYING OUT THE INVENTION

First Embodiment

Figure 1:
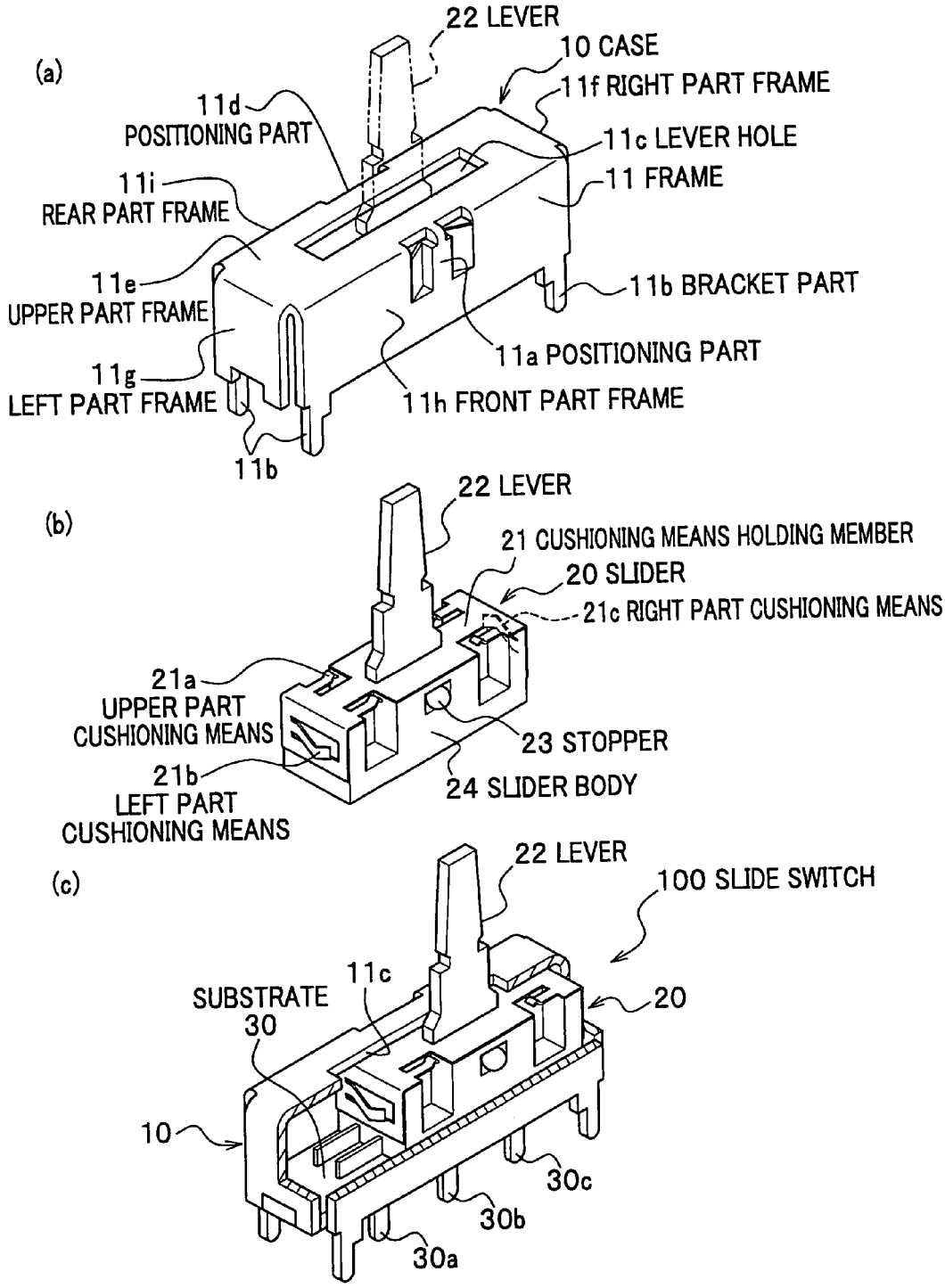
FIG. 1 is a perspective view of a slide switch according to a first embodiment (with a three-position switching part), wherein (a) is a perspective view of a case, (b) is a perspective view of a slider, and (c) is a perspective view of the slide switch assembled to include the case and the slider and partially cut.

Hereinbelow with reference to drawings will be described a first embodiment of the present invention. FIG. 1 shows an internal configuration of a slide switch 100 according to the first embodiment of the present invention. FIG. 1(*a*) is a perspective view illustrating a case. FIG. 1(*b*) is a perspective view of a slider. FIG. 1(*c*) is a perspective view of the slide switch assembled to include the case and the slider and partially cut.

As shown in FIG. 1, the slide switch 100 is configured with a case 10, a slider 20, and a substrate 30.

As shown in FIG. 1(*a*), the case 10 is configured with a frame 11 of which five faces are surrounded and of which one face is opened. The frame 11 is formed by a process of folding a plate member, i.e., the frame 11 is subject to the folding process to form a front part frame 11*h*, a rear part frame 11*i*, a left part frame 11*g*, a right part frame 11*f*, and an upper part frame 11*e*.

Here, "front/rear", "right/left", and "upper/lower" of the slide switch 100 are defined such that, when FIG. 1 is viewed from the front, a near side is referred to as "a front part"; a rear side, "a rear part"; a left side, "a left part"; an upper side, "an upper part"; and a lower side, "a lower part".

At an inner face of an almost middle part of the front part frame 11*h*, is formed a positioning part 11*a* for positioning a lever 22 of the slide switch 100 at three positions. At an inner face of an almost middle part of the front part frame 11*i* facing the positioning part 11*a*, is formed a positioning part 11*d* for positioning the slide switch 100 at two positions. At a middle part of the upper part frame 11*e* is formed a lever hole 11*c*. The lever 22 provided on the later mentioned slider 20 is pierced through the lever hole 11*c*. At a lower corner of the case 10, is provided a bracket part 11*b* for fixing the case 10 to a PC board (not shown) and the like.

As shown in FIG. 1(*b*), the slider 20 is configured to include a slider body 24, a cushioning means holding member 21 fixed to the slider body 24, the lever 22, and a stopper 23. At the cushioning means holding member 21 are integrally provided an upper part cushioning means 21*a*, a left part cushioning means 21*b*, and a right part cushioning means 21*c*. The upper part cushioning means 21*a* is provided at four upper places in a vertical direction and has a plate-like spring member curved in a semicircle. The left part cushioning means 21*b* and the right part cushioning means 21*c* are provided at the left and the right of the slider body 24, respectively, and configured with leaf springs having a form of a mark "<" protruding toward contacting places where the case 10 is in contact with the slider 20.

Further, at a front part of a front and a rear sliding face of the slider body 24 is provided the stopper 23. The stopper 23 slidably protrudes from the front part of the slider body 24 and energized by a coil spring (not shown).

As shown in FIG. 1(*c*), the substrate 30 is fixed to an opening at a lower part of the case 10. At the lower part of the substrate 30 are provided terminals 30*a*, 30*b*, and 30*c*, downwardly protruding, used for electric wiring. The substrate 30 under the slider supports the slider 20 so as to make the slider 20 slidable. As described above, on the substrate 30 is mounted the slider 20, and the lever 22 mounted on an upper part of the slider body 24 (see FIG. 1(*b*)) is inserted through the lever hole 11*c* of the case 10 to form the slide switch 100. The substrate 30 is formed by shaping a laminated plate of phenolic resin (bakelite board).

Here, a material of the substrate 30 is not specially limited as long as it has an insulating characteristic, i.e., it may be an insulating material generally used.

According to the slide switch 100 of the first embodiment described above, the upper part cushioning means (hereinafter, also referred to as a leaf spring) 21*a* and left and right part cushioning means (hereinafter, also referred to as leaf springs) 21*b*, and 21*c* cushion the contact of the slider 20 with the case 10 due to the switch operation to the lever 22, so that the contact noise due to the contact, i.e., the operation noise, can be reduced, with the result that a feeling in the switch operation can be improved by the reduction of the operation noise.

In the slide switch 100 of the first embodiment, the leaf spring 21*a* and the leaf springs 21*b* and 21*c* are used as cushioning members, however, they may be any member having such an elasticity as to cushion the contact of the slider body 24 with the case 10. For example, a spring spring, silicone rubber, a resin, and the like can be used.

Figure 2:
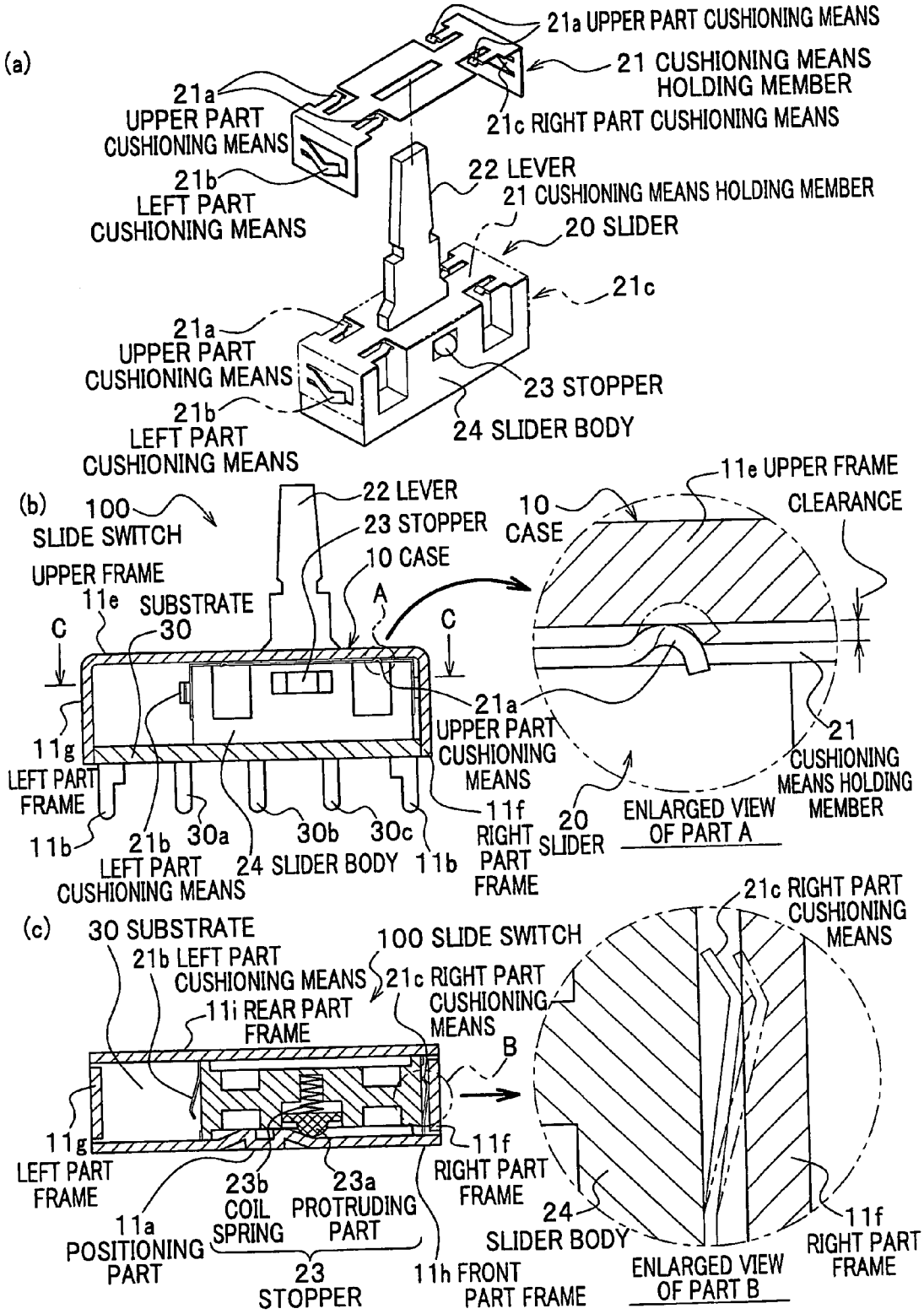
FIG. 2 illustrates the slider with a cushioning means, wherein (a) is a perspective view showing configurations of the slider body and the cushioning means holding member, (b) is an illustrative view illustrating an operation of an upper part cushioning means, and (c) is an illustrative view illustrating an operation of the left and right cushioning means (left part cushioning means and the right part cushioning means).

Next, will be described an operation of the slide switch according to the first embodiment. FIG. 2(*a*) is an exploded perspective view of the slider 20. FIG. 2(*b*) is a cross-sectional configuration drawing illustrating an operation of the upper part cushioning means. FIG. 2(*c*) is a cross-sectional view taken along line C-C in FIG. 2(*b*) and a configuration view illustrating the operation of the left and right part cushioning means.

As shown in FIG. 2(*a*), the cushioning means holding member 21 has the upper part cushioning means 21*a*, 21*a*, 21*a*, and 21*a* at four upper places on the cushioning means holding member 21. The upper part cushioning means 21*a* is shaped in a plate-like shape curved in a semicircle directed to a vertical upward direction to generate a pressing force toward the vertical upward direction.

Further, the left and right part cushioning means (the left part cushioning means and the right part cushioning means) 21*b* and 21*c* are configured on left and right side faces of the slider body 24 with a leaf spring protruding in the form of the mark "<" at contacting places where the case 10 comes in contact with the slider 20 so as to generate an pressing force leftward and rightward.

As described above, the upper part cushioning means 21*a*, the left and right part cushioning means 21*b* and 21*c* are integrally provided with the cushioning means holding member 21.

As shown in FIG. 2(*a*), the upper part cushioning means 21*a*, 21*a*, 21*a*, and 21*a* are provided at the upper part of the slider body 24, and in contact with a lower face of the upper part frame 11*e* of the case 10 as shown in an enlarged view of a part A in FIG. 2(*b*). In other words, a reverse of the upper part frame 11*e* is in contact with the upper part cushioning means 21*a*. As mentioned above, the upper part cushioning means 21*a*, 21*a*, 21*a*, and 21*a* energize the lower face of the upper part frame 11*e*. Accordingly, the slider 20 smoothly slides within the case 10 by a clearance provided between the upper part frame 11*e* and the slider 20 and an energizing force of the upper part cushioning means 21*a*. This can reduce, in the slide switch 100, the generation of the contact noise due to the switch operation as well as the vibration noise of the slide switch due to the vibration of the vehicle under traveling.

As shown in FIG. 2(*c*), the left and right part cushioning means 21*b* and 21*c* are provided on the left and right side faces of the slider body 24 (see FIG. 2(*b*)), and as shown in an enlarged view of a part B, configured with leaf springs protruding in the form of the mark "<" to generate energizing forces leftward and rightward at contacting places where the case 10 is in contact with the slider 20. The right part cushioning means 21*c* which is the leaf spring protruding in the form of the mark "<" is in contact with the right part frame 11*f*. In this event, the right part cushioning means 21*c* energizes an inner side face of the right part frame 11*f*. Further, the stopper 23 comprising a protruding part 23*a* energized by a coil spring 23*b* is positioned by the positioning part 11*a*. In this event, the stopper 23 energized by an elastic force causes the slider 20 to smoothly slide within the case 10 to the positioning part. The slider 20 is positioned by the positioning part 11*a* and at the same time comes in contact with the contacting place of the case 10 by the energizing force of the right part cushioning means 21*c*. As mentioned above, the slide switch 100 can reduce the generation of the contact noise due to the switch operation as well as the vibration noise of the slide switch 100 due to the vibration of the vehicle under traveling, improving the operation feeling of the vehicle.

Figure 3:
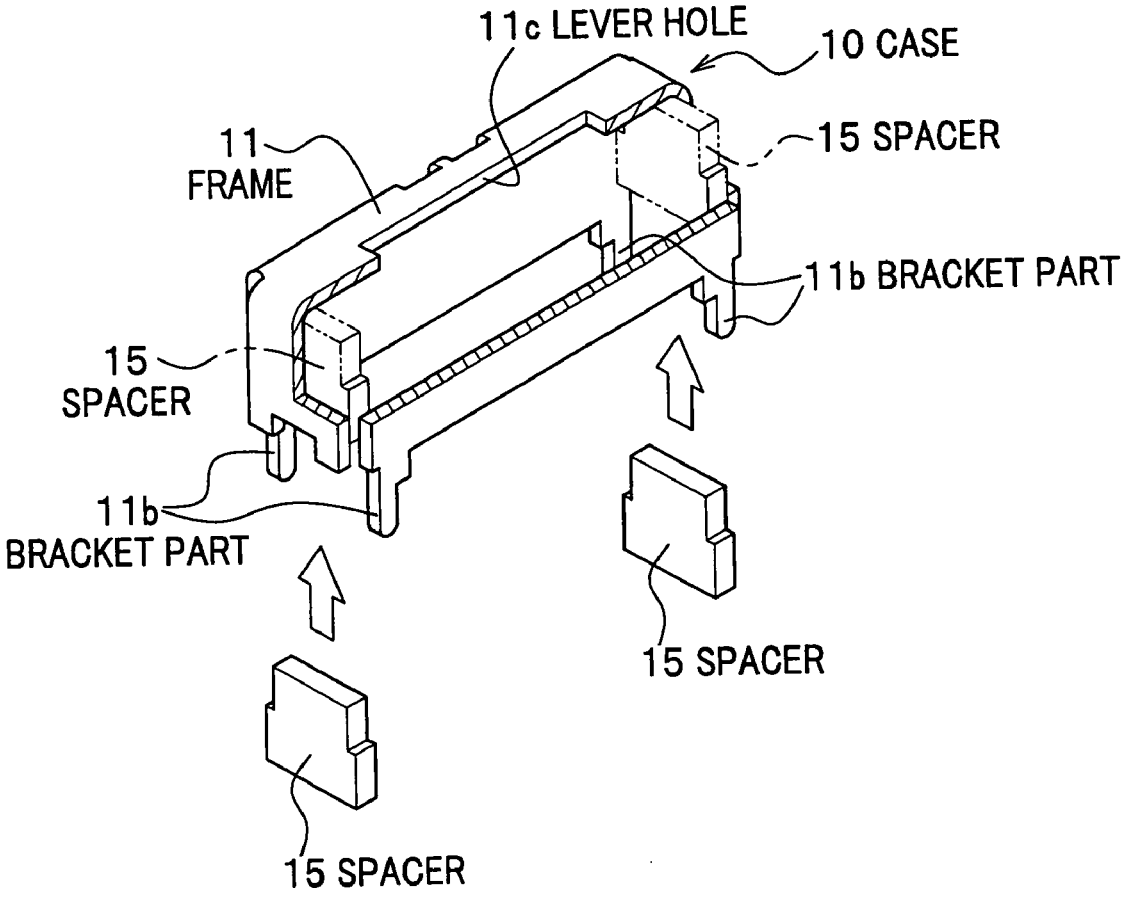
FIG. 3 is a perspective view of spacers for adjusting stop positions.

FIG. 3 shows a manner in which spacers 25 are inserted.

As shown in FIG. 3, the spacers 15 are fitted in the inside of left and right side faces of the case 10. This can adjust a sliding distance of the slider (see FIG. 1) within the case 10 (see FIG. 1).

The spacers 15 will be described later in details in FIG. 5.

Figure 4:
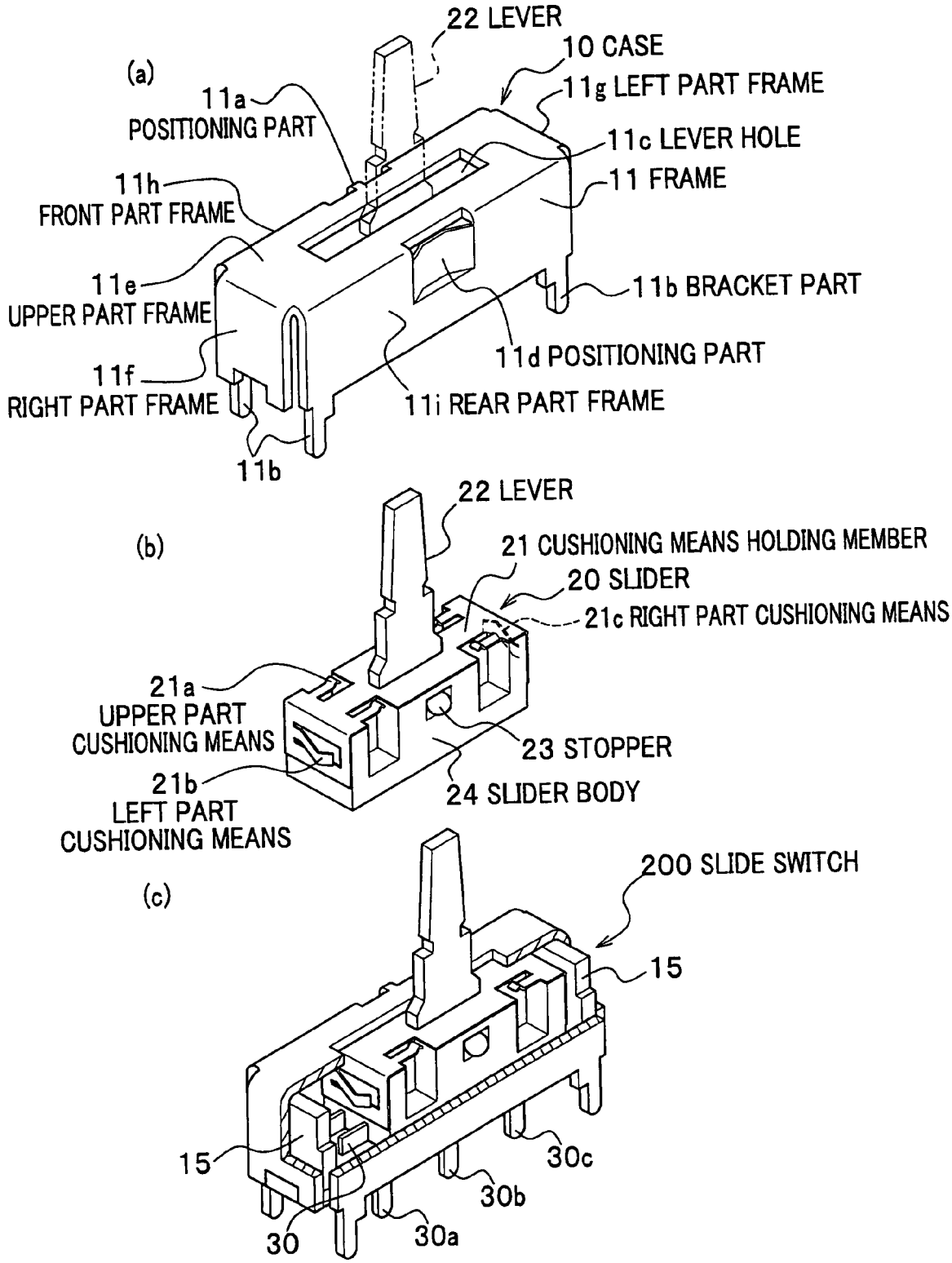
FIG. 4 is a perspective view showing a slide switch (with a two-position switching part) according to the first embodiment, wherein (a) is a perspective view of the case, (b) is a perspective view showing the slider, and (c) is a perspective view of the slide switch assembled to include the case and the slider and partially cut.

FIG. 4 shows an internal configuration of the slide switch 200 according to the first embodiment of the present invention. FIG. 4(*a*) is a perspective view of the case. FIG. 4(*b*) is a perspective view of the slider. FIG. 4(*c*) is a perspective view of the slider switch assembled to include the case and the slider and partially cut.

The slide switch 200 is different from the slide switch 100 in that the slide switch 200 is assembled to allow a positioning part 11*d* to position the lever 22 of the slide switch 200 at two positions in contrast to the slide switch 100 assembled to allow the positioning part 11*a* to position the lever 22 of the slide switch 100 at the three positions.

As shown in FIG. 4(*a*), the positioning part 11*d* in the case 10 is arranged in the near side of the drawing (hereinafter referred to as front). This is because the rear part frame 11*i* located rearward in the slide switch 100 is arranged in the front of the drawing as well as the positioning part 11*d* is arranged in the front of the drawing. In this condition, as shown in FIG. 4(*b*), the slider 20 is positioned to locate the stopper 23 in the front of the drawing, and the stopper 23 is positioned at two positions by the positioning part 11*d*. More specifically, a positional relation between the case 10 of the slide switch 100 and the slider 20 is moved by rotating by 180° to form the slide switch 200.

As shown in FIGS. 4(*b*) and 4(*c*), the spacers 15 are arranged at left and right ends of the case 10 to limit a moving distance of the slider 20. The spacers 15 are members having an elastic characteristic. Thus, they do not easily come off because they are mounted in the case 10 with it slightly curved.

Figure 5:
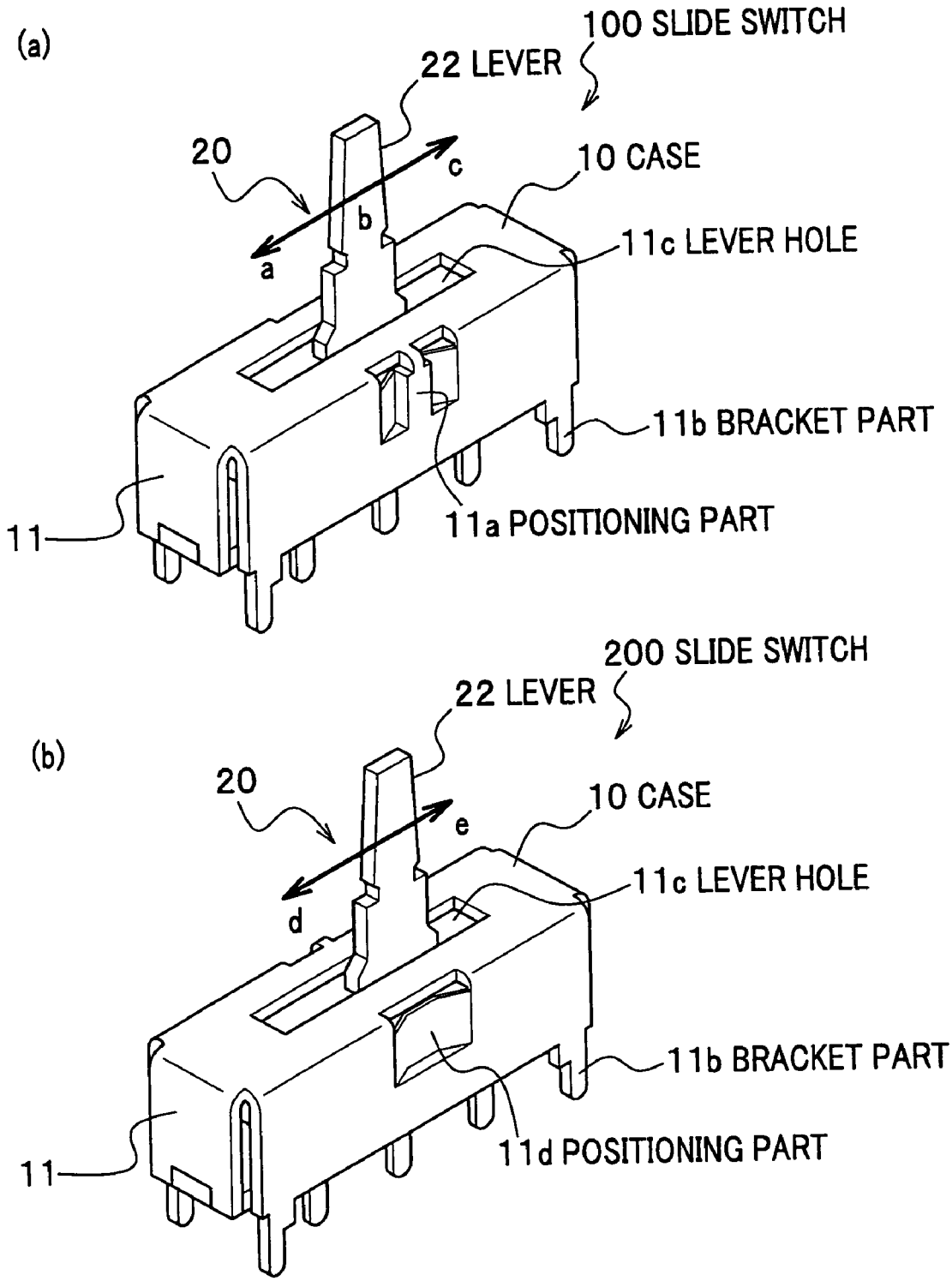
FIG. 5 is a drawing illustrating an operation of the slide switches of the three-position type and the two-position type, wherein (a) illustrates the three-position type one, and (b) illustrates the two-position type one.

FIG. 5 is a drawing illustrating an operation of the slide switches of the three-position type (in a case of the slide switch 100) and the two-position type (in a case of the slide switch 200). FIG. 5(*a*) illustrates a case of the three-position type. FIG. 5(*b*) illustrates a case of the two-position type.

As shown in FIG. 5(*a*), in the slider 20 stop positions are determined by the positioning part 11*a*, so that the slider 20 stops at three positions indicated by an arrow and stop positions "a", "b", and "c."

As shown in FIG. 5(*b*), in the slider 20 stop positions are determined by the positioning part 11*d*, so that the slider 20 stops at two positions indicated by an arrow and stop positions "d" and "e."

The positioning parts 11*a* and 11*d* are formed as the positioning part 11*a* located in a front face and the positioning part 11*d* facing a rear face so as to position the lever 22, commonly using the case 10.

More specifically, as shown in FIG. 5(*a*), the positioning part 11*a* positions the lever 22 to stop at a position "b" at the middle, and stops at the left and right stop positions "a" and "c" upon coming in contact with the case 10. Thus, at contacting places of the case 10 are provided left and right part cushioning means 21*b* and 21*c* (see FIG. 1).

As shown in FIG. 5(*b*), the positioning part 11*d* does not stop the lever 22 at the middle but moves to the left and the right, and the lever 22 stops at left and right stop positions "d" and "e" upon coming in contact with the case 10. Thus, at contacting places with the case 10 are provided the left and right part cushioning means 21*b* and 21*c* (see FIG. 4).

Thus, if the same case 10 is used for the three-position type and the two-position type, the left and right stop positions "a" and "b" of the slide switch 100 are the same as the left and right stop positions "d" and "e" of the slide switch 200. Accordingly, the moving distances of the lever 22 become the same as a whole, which is actually inconvenient. More specifically, strokes of one position in the three-position type and the two-position type become approximately two times, which is not always convenient. In the case of the two-position type of switching, switching with the same stroke as that of the three-position type of switching provides a preferable operation feeling to prevent such an erroneous operation that the lever 22 is caused to stop halfway.

For this reason, as shown in FIG. 3, the above-described stoppers 15 are fitted at the left and the right of an inner side of the case 10 to stop the slider 20 by making contact of the slider 20 with the spacer 15. In this event, the left part cushioning means 21*b* and the right part cushioning means 21*c* are provided on the side of the slier 20, so that this can be provided only by mounting the stoppers 15 at the left and the right of the inner of the case 10, which is extremely easy with a sure switching operation.

Further, when the case 10 commonly usable between the two-position type and the three-position switching type is used, the moving distance of the lever 22 is made constant, with a favorable operability. This can prevent an error such as a halfway stop of the slide switch from occurring (the halfway stop is not a stop at a predetermined position but refers an erroneous stop of the lever of the switch at a halfway because a stroke for turning on and off the switch is long).

As mentioned above, the case 10 and the slider 20 can be commonly used between the slide switch 100 and the slide switch 200. This can save a manufacturing cost of a metal mold and reduce man-hour for maintaining parts and its management.

Second Embodiment

Figure 6:
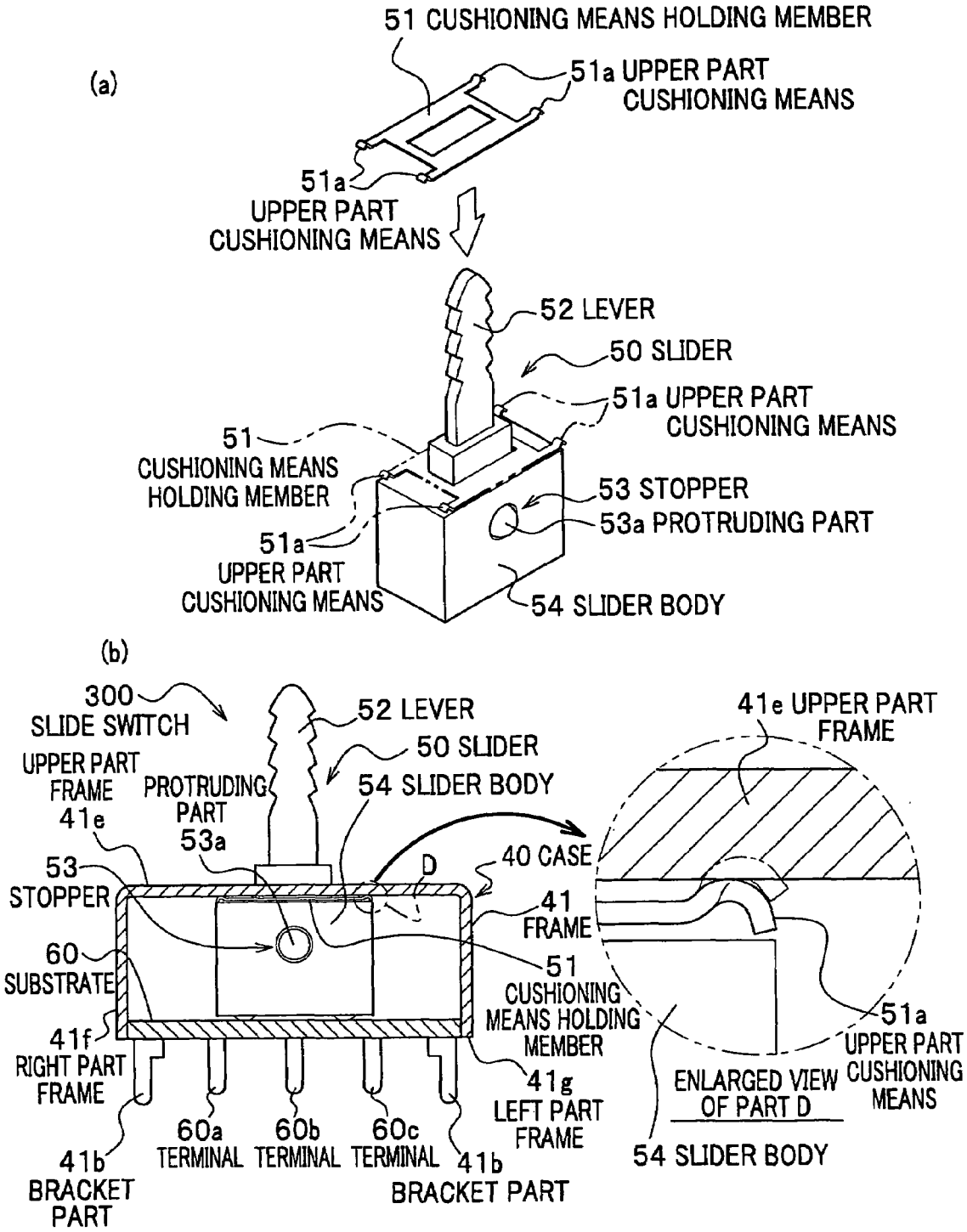
FIG. 6 shows a slide switch 300 according to a second embodiment, wherein (a) is a perspective view of a slider, and (b) is a drawing illustrating its operation.

FIG. 6 shows an internal configuration of the slide switch 300 according to a second embodiment of the present invention. FIG. 6(*a*) is a perspective view illustrating a slider. FIG. 6(*b*) is a configuration drawing illustrating an operation of the slide switch in which a case and the slider are assembled.

A difference in the second embodiment from the first embodiment is, in contrast to the first embodiment in which the energizing force is applied to an upper part of the slider by the leaf springs, that the energizing force is generated at upper and lower parts of the slider 50. Thus, in the second embodiment, the same elements are designated with the same references as the first embodiment, and the detailed descriptions are omitted.

As shown in FIGS. 6(*a*) and 6(*b*), the slide switch 300 is configured with a case 40, the slider 50, and a substrate 60. The slider 50 includes a slider body 54, a cushioning means holding member 51, a stopper 53, and a lever 52.

As shown in an enlarged view of a part D, at an upper part of the slider body 54 is mounted the cushioning means holding member 51. On the upper face of the cushioning means holding member 51 at four places are provided leaf springs curved in a semicircle upwardly protruding. The cushioning means holding member 51 is sandwiched between an upper face of the slider body 54 and the case 40. An upper part cushioning means 51*a* energizes the upper part frame 41*e* at its lower face. Thus, the slider 50 smoothly slides within the case 40. This can reduce the generation of the contact noise due to the switch operation in the slide switch 300 as well as the vibration noise of the slide switch due to the vibration of the vehicle under traveling with an improved operation feeling of the vehicle.

Figure 7:
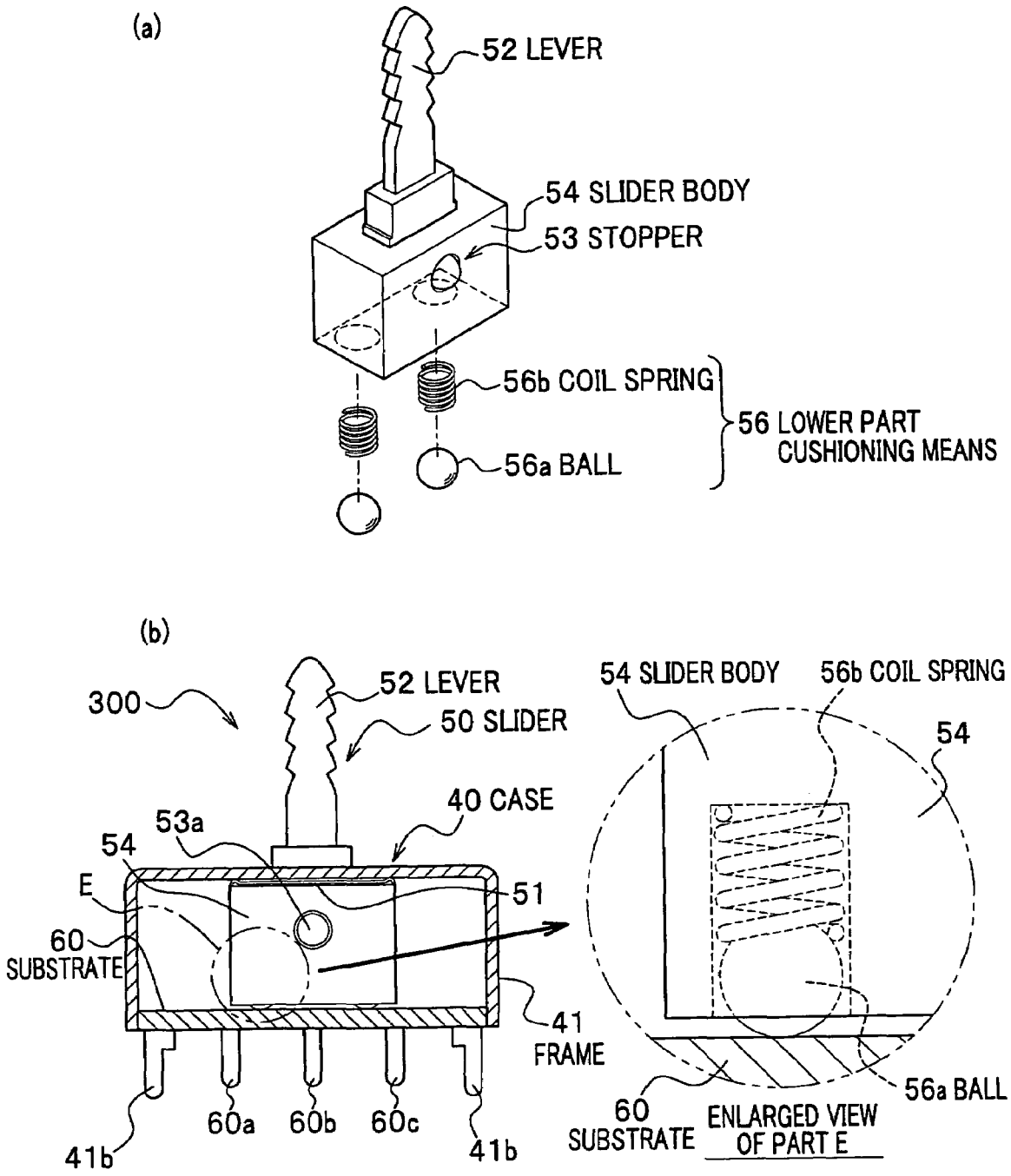
FIG. 7 shows the slider with the cushioning means, in which a lower face of the slider is supported by a coil spring, wherein (a) is a perspective view illustrating a lower part cushioning means, and (b) is a drawing illustrating an operation of the lower part cushioning means.
Figure 8:
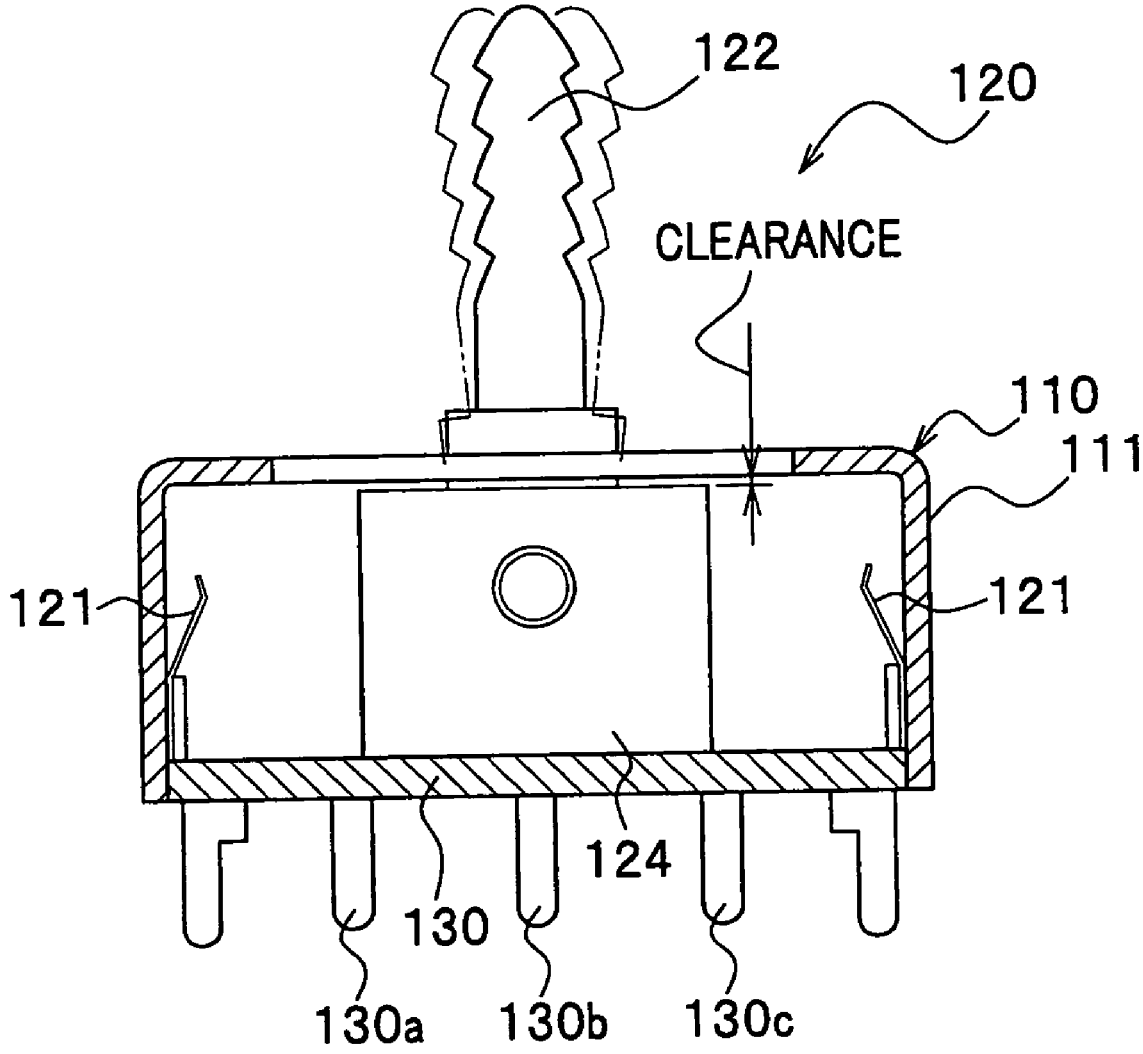
FIG. 8 is a configuration drawing showing an outline of an inner configuration of a conventional slide switch.

FIG. 7 shows an inner configuration of a mechanism for sliding a lower part of the slider 54 with balls. FIG. 7(*a*) is a perspective view illustrating a lower part cushioning means, and FIG. 7(*b*) is a sectional configuration drawing illustrating an operation of the lower part cushioning means.

As shown in FIG. 7(*a*), at a lower part of the slider 54 is provided a lower part cushioning means 56. The lower part cushioning means 56 are provided with balls 56*a* which are, being supported by coil springs 56*b*, mounted so as to slightly protrude from holes provided in the lower face of the slider body 54. Here, the balls 56*a* correspond to protruding parts shown in Claims.

As shown in an enlarged view of a part E in FIG. 7(*b*), the slider body 54 is slidably supported by the balls 56*a* between itself and the substrate 60. More specifically, a slidable support between the slider body 54 and the substrate 60 is provided by the balls 56*a* supported by the coil springs 56*b*. Thus, in the slide switch 300, the contact noise due to the switch operation can be reduced as well as the vibration noise of the slide switch 300 can be reduced with an improved operation feeling of the vehicle.

As mentioned above, modes of the present invention have been described using the embodiments. However, the present invention is not limited to these embodiments and thus, can be embodied in a various modes without departing from the spirit and scope of the present invention. For example, not specially specifying, a material of the case may be a metal or a resin. Further, such a slide switch is applicable to vibrations due to a speaker in an acoustic apparatus and the like.

INDUSTRIAL APPLICABILITY

According to the cushioning means holding member and the slide switch according to the present invention, at the contacting places where the slider sliding within the slide switch comes in contact with the case housing the slider, the cushioning means for cushioning in at least one of the horizontal direction and the vertical direction of the slider is integrally provided with the cushioning means holding member to prevent contact with each other, so that the generation of the contact noise due to the switch operation can be reduced as well as the vibration of slide switch due to vibration of the vehicle under traveling with the improved operation feeling of the vehicle.

The invention claimed is:

1. A cushioning means holding member, provided in a slide switch including a slider and a case into which the slider is inserted to provide switching by a sliding operation of the slider and provided at a contacting place in a side of the slider where the slider comes in contact with the case by a sliding operation of the slider for relieving the contact, characterized in that the cushioning means holding member integrally includes cushioning means for cushioning in at least one of a horizontal direction in which the slider is slid and a vertical direction in which an upward-downward movement of the slider is limited.

2. The cushioning means holding member as claimed in claim 1, characterized in that the cushioning means is provided at the contacting place in the side of the slider and is a leaf spring protruding in a shape of a mark of"<" in a horizontal direction.

3. The cushioning means holding member as claimed in claim 1, characterized in that the cushioning means is provided at the contacting place in the side of the slider and is a leaf spring curved in a semicircle in the vertical direction.

4. The cushioning means holding member as claimed in claim 1, characterized in that the cushioning means is a springy member, formed of a material having an elastic characteristic.

5. A slide switch characterized in that the cushioning means holding member as claimed in claim 1 is provided.

6. The slide switch as claimed in claim 5, characterized in that the case has case inner faces in which the slider slides, the case inner faces face each other along the horizontal direction, one of the case inner faces has a positioning part for positioning the slider at three positions, and the other of the case inner faces has a positioning part for positioning the slider at two positions.

7. The slide switch as claimed in claim 5, characterized in that the slider includes a protruding part protruding from a lower face of a slider body and the protruding part is pressed by an elastic member to support the slider on a substrate to make the slider slidable.

* * * * *